United States Patent [19]

West

[11] 4,452,390

[45] Jun. 5, 1984

[54] PORTABLE SECURITY CONTAINER

[75] Inventor: Robert A. West, Kailua-Kona, Hi.

[73] Assignee: Boxlox, Inc., San Carlos, Calif.

[21] Appl. No.: 403,571

[22] Filed: Jul. 30, 1982

[51] Int. Cl.[3] ..... A47G 29/14

[52] U.S. Cl. ..... 232/4 R; 232/43.2; 109/45

[58] Field of Search ..... 232/43.1, 43.2, 43.3, 232/43.4, 43.5, 44, 47, 53, 4 R, 4 D; 109/46, 47, 45, 52–55

[56] References Cited

U.S. PATENT DOCUMENTS

| | | | |
|---|---|---|---|
| 1,826,528 | 10/1931 | Schnier | 232/4 R |
| 2,120,514 | 6/1938 | Stephens | 232/4 R |
| 2,323,221 | 6/1943 | Hockey et al. | 232/4 R |
| 2,429,494 | 10/1947 | Stephens | 232/4 R |
| 2,465,431 | 3/1949 | Cisenfeld | 232/4 R |
| 3,292,849 | 12/1966 | Ewing | 232/15 |

*Primary Examiner*—Gene Mancene
*Assistant Examiner*—Kris R. Schulze
*Attorney, Agent, or Firm*—Flehr, Hohbach, Test, Albritton & Herbert

[57] ABSTRACT

A portable safe adapted to be disposed and locked within a housing located at a work station receives currency deposited directly into the safe without exposing the contents of the safe. The safe includes a currency transfer tray movable into and out of the container and a pivoting wiper element for sweeping or wiping the tray to discharge currency from the tray into the safe. The tray serves to block the opening through which currency is passed into the safe.

4 Claims, 7 Drawing Figures

10
11
12
13
13
14
15
16
17
18
19
20
20
25
26
27
28
29
30
3,4,5
3,4,5

PORTABLE SECURITY CONTAINER

This invention pertains to portable safes or security containers arranged to be locked within a housing in a manner permitting currency, sales slips, credit card vouchers and the like to be deposited therein without removing the safe.

In gambling establishments, currency is received by dealers from the players and exchanged for playing chips. The currency received is depostied immediately into a locked, metal security box attached beneath the playing table. The security box is commonly called a "drop box" characterized by a currency-receiving slot communicating with a similar slot in the table beneath which the "drop box" is mounted. Periodically, casino security personnel remove the "drop box" from its position beneath the table and take it to a secure counting room for opening, emptying and accounting for the currency collected.

While casinos and other gambling establishments represent an important application for use of "drop boxes" of the kind described, department stores and others can also use portable security containers as described herein for collecting sales slips, credit card vouchers, discount coupons and money so as to provide tamper proof means for transfering current, vouchers, etc. from a given cash register to a more secure location. A relatively simple tamper proof security box assembly adapted to prevent the unauthorized removal of either the contents from the box or the box from its mounting may be used for some of these applications.

For simplicity, as used herein, the term "currency" shall be deemed to include cash, credit card vouchers, discount coupons, sales slips, and the like, whether loosely deposited or carried in an envelope.

Accordingly, there has been a need for an improved apparatus for receiving, storing and transporting valuables.

In general it is an object of the present invention to provide a simplified, tamper proof box and mounting assembly.

It is another object of the present invention to provide such a tamper proof security box in which the slot for depositing currency etc. into the box remains substantially closed at all times to inhibit invasion of the contents of the box by "fishing".

The foregoing and other objects of the invention will become more readily evident from the following detailed description of a preferred embodiment when considered in conjunction with the drawings.

Figure 1:
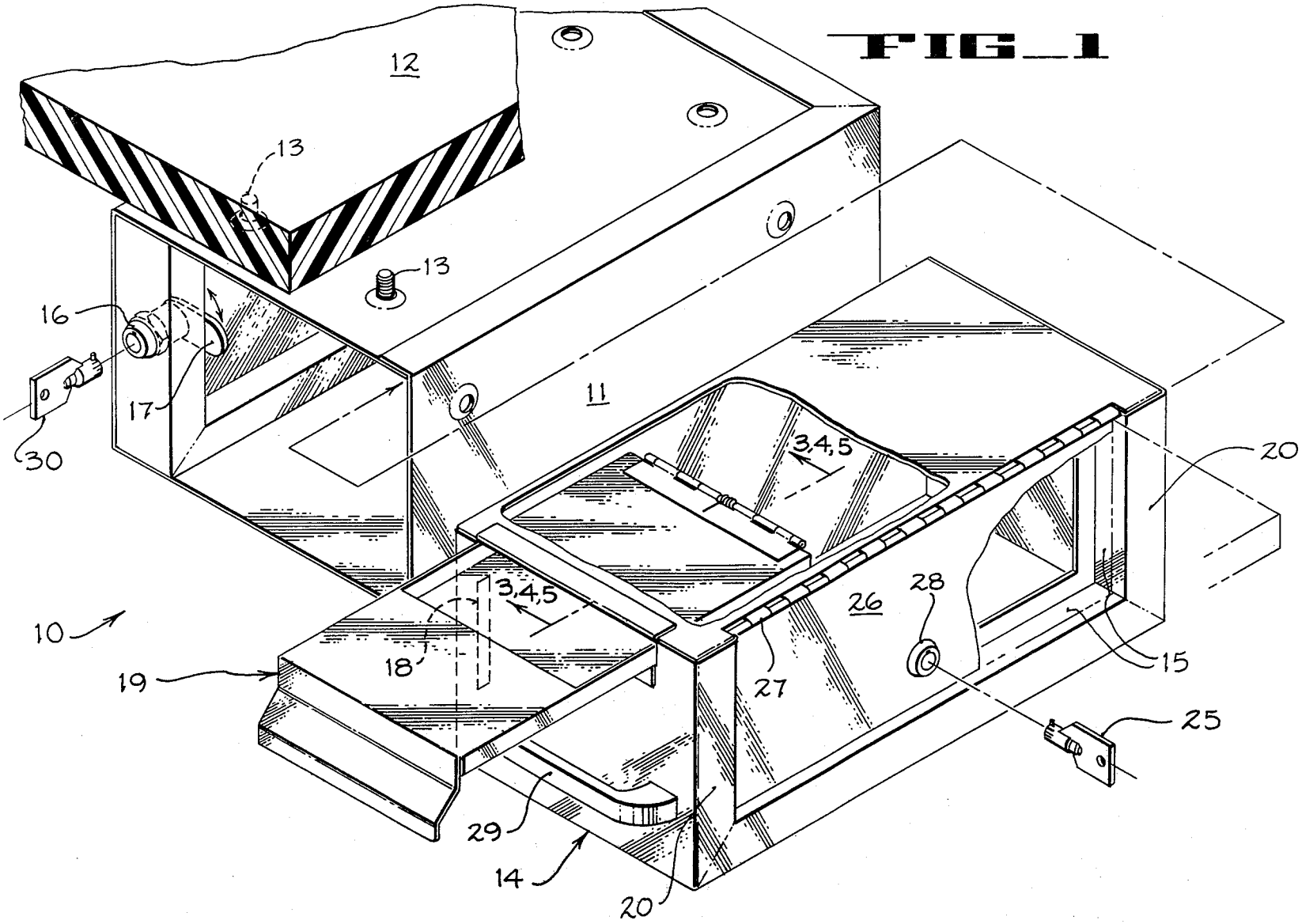
FIG. 1 shows a diagrammatic perspective exploded view with portions broken away for clarity of a security box assembly according to the invention.

In general, as shown in FIG. 1, a security box assembly 10 for safely receiving and storing currency includes a hollow, reinforced rigid elongate jacket 11. The housing is open at one end for receiving a portable safe or container 14 therein. The jacket is adapted to be securely mounted to a support member such as a counter top 12 or the like at a work station by means of screws extending upwardly through the openings 13.

A closed security container 14 is sized to closely fit within housing 11. Key operated locking means such as the cylindrical lock 16 operates a locking blade 17 to move into and out of a locking slot 18 formed through the adjacent side wall of container 14. Accordingly, lock 16 may be selectively operated to retain or release container 14 with respect to jacket or housing 11. Preferably the locks 28, 16 are of a type wherein keys 25, 30 can only be removed when in their locked position to prevent a failure to engage the locking blade 17 within slot 18, for example.

Container 14 includes a currency delivery tray 19 movable into and out of container 14 between inserted and retracted positions.

A tray receiving channel or guideway 21 protrudes into container 14 for guiding the movements of tray 19. Thus, channel 21 forms a guideway of rectangular cross-section formed with a pair of top and bottom surfaces and joined at its side edges by side walls.

Figure 2:
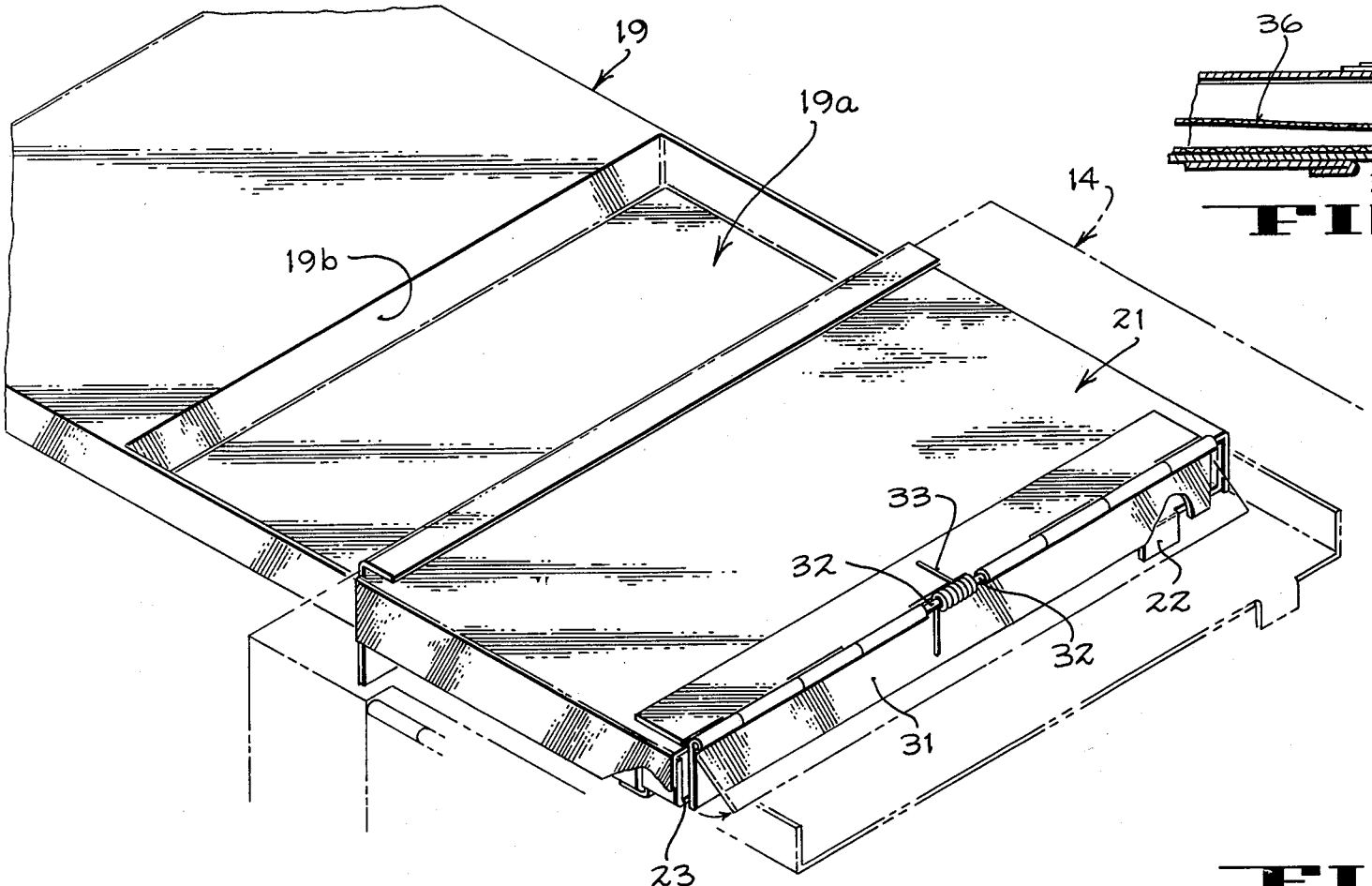
FIG. 2 shows a diagrammatic perspective view in enlarged detail showing a currency delivery tray and means for clearing currency from the tray for transfer into the security box.

As shown in FIG. 2, tray 19 has been moved to its fully retracted position. Means for limiting the retracting movement of tray 19 includes the downwardly directed tab or stop 22 bent downwardly from the leading edge 23 of tray 19. Accordingly, as tray 19 is withdrawn toward its retracted position tab 22 will ultimately engage the innermost edge of the bottom wall 24 of channel 21 to prevent full removal of tray 19 for access to the contents of container 14.

A closure member or door 26 supported from an elongate piano hinge 27 carries a cylindrical lock 28 whereby the contents of container 14 can be removed by opening door 26. In order to permit safe or container 14 to be closely fitted within jacket 11, lock 28 must not protrude. Accordingly, as disclosed in FIG. 1, closure 26 has been sufficiently recessed into the access opening 15 formed through the side wall 20 of safe 14 to dispose lock 28 behind the plane of side wall 20.

After safe 14 has been released from jacket 11 it can be readily transported to an appropriate station. Thus, in order to assist in the portable nature of safe 14 a handle grip 29 has been secured to that end of container 14 including tray 19.

Tray 19 includes a currency receiver portion 19*a* into which currency, including small envelopes, or the like as noted above can be disposed to be deposited into container 14.

Figure 6:
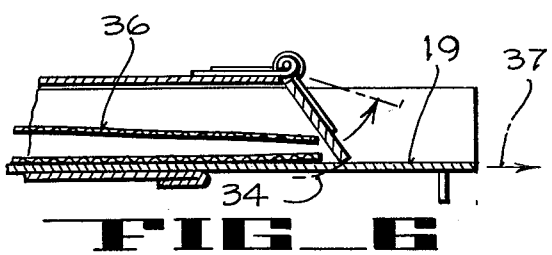
FIGS. 6 and 7 show schemmatic diagrams for use in explaining the functioning of a wiper element serving to clear currency from the currency delivery tray.

Accordingly, means for transferring currency from tray 19 into containers 14 in response to movement of tray 19 between inserted and retracted positions includes a wiper element 31 for sweeping or clearing currency out of portion 19*a* and into container 14 as now to be discribed. A stationary pivot pin 32 disposed above and supported across tray 19 supports wiper element 31. A spring 33 urges wiper element or sweeping means 31 toward tray 19. Wiper element 31 pivots yieldingly upwardly to pass over currency carried in receiver portion 19*a* of tray 19 in rosponse to movement of tray 19 toward its inserted position. (FIG. 6)

Figure 7:
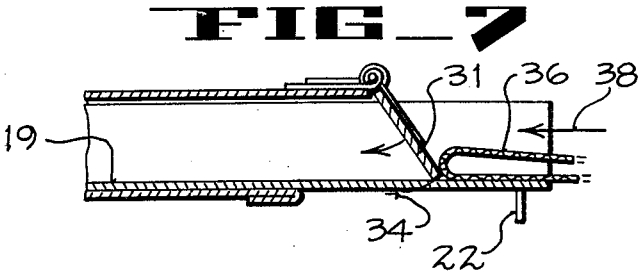
Figure 3:
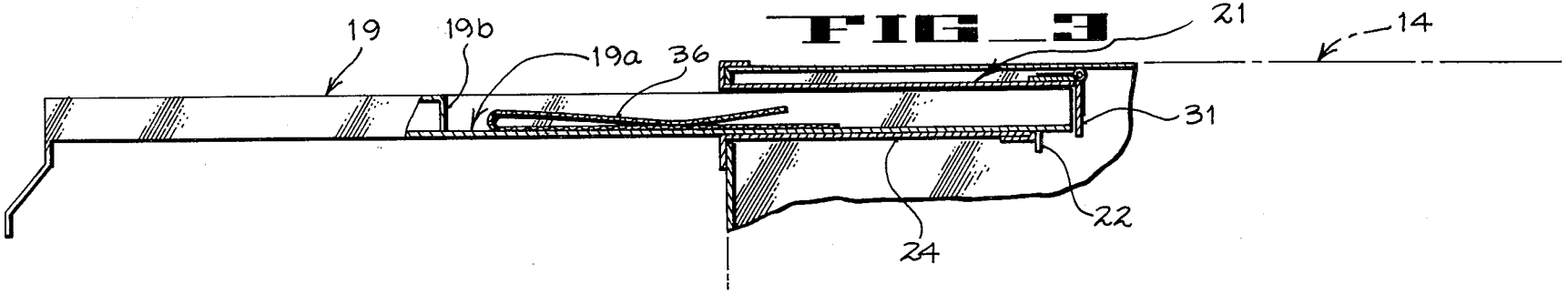
FIGS. 3, 4 and 5 show side elevation diagrams of three stages of operation of the delivery tray shown in FIG. 2.

Wiper element 31 moves downwardly along an imaginary arc 34 (FIGS. 6, 7) to be arrested by the bottom of tray 19. With element 31 engaging tray 19, movement of tray 19 towards it retracted position urges currency from the tray into the container.

Ultimately, currency 36 will lie to the right hand side (FIG. 7) of wiper element 31. Thus, when tray 19 is moved in a reverse direction represented by arrow 38, wiper element 31 will be inhibited from passing over the top of currency 36 since the lower edge of element 31 will be arrested by the upper surface of tray 19. Accordingly, movement of tray 19 in the direction of arrow 38 serves to transfer currency 36 from tray 19 into container 14.

Preferably the surface of receiver portion 19*a* permits relatively free sliding movement of the lower edge of element 31 therealong as tray 19 is retracted.

Figure 4:
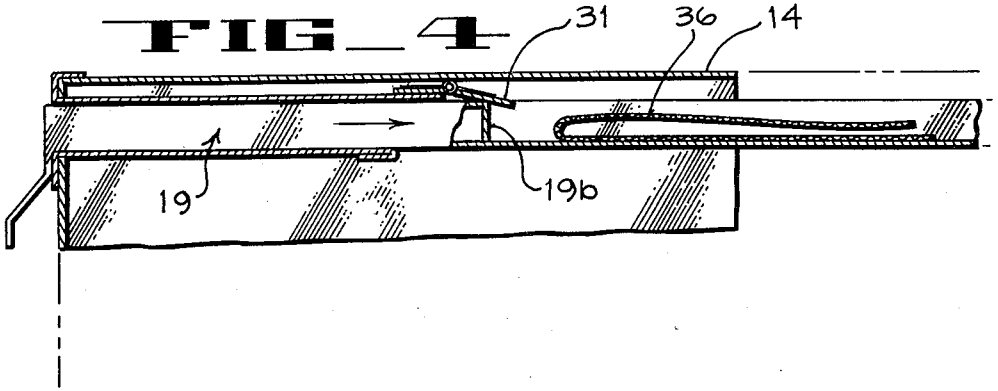
Figure 5:
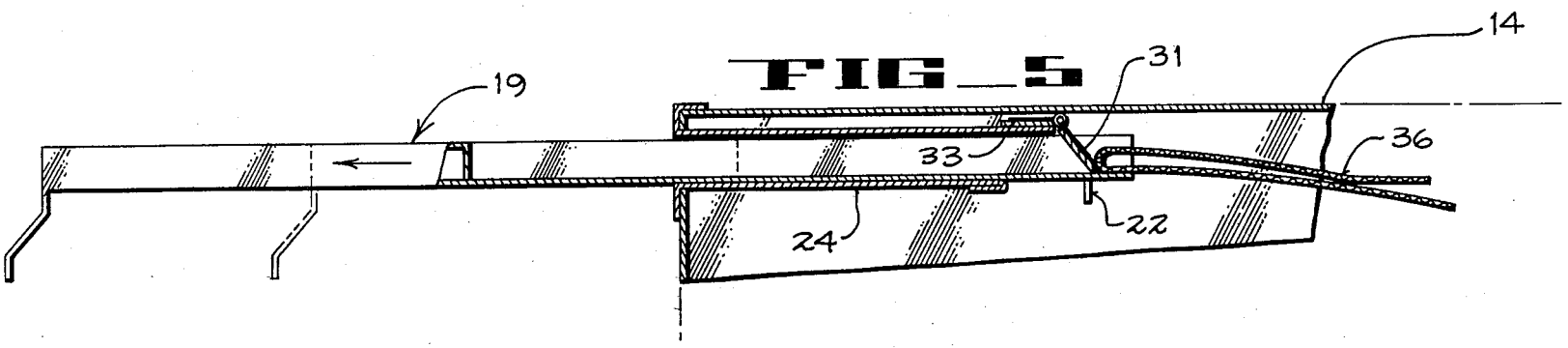

In addition to the above, the trailing portion of tray 19 includes means for positively elevating wiper element 31 upwardly sufficiently to permit the lower edge of wiper element 31 to move downwardly onto the currency disposed in receiver portion 19*a*. Thus, as shown best in FIG. 4, the back wall 19*b* of receiver 19*a* is disposed and arranged to engage wiper element 31 as tray 19 is inserted into container 14. Thus, when fully inserted, wiper element 31 will be positively lifted above the level of currency 36 carried in receiver portion 19*a*. As tray 19 is moved to its inserted position, element 31 will be lowered downwardly onto currency 36 or onto the surface of receiver portion 19*a*.

Thus, in a portable safe of the type shown, currency sweeping means are supported with respect to the tray 19 to be free to pass over currency disposed in the tray as the tray moves in a first direction and to be inhibited from passing over the same currency in the tray as the tray moves in an opposite direction. The movement in the opposite direction serves to urge the currency against the sweeping means (in its inhibited state) so as to transfer the currency from the tray into the container 14.

From the foregoing it will be readily evident that there has been provided an improved portable safe construction and mounting assembly of a type whereby currency can be deposited safely into the reinforced container 14 by means of tray 19. It will be further evident that the use of the tray construction for depositing currency into container 14 prevents any access to the contents of container 14 other than by means of the locked panel 26.

I claim:

1. A security box assembly for safely receiving and storing currency comprising a hollow, rigid, elongate jacket open at one end, said jacket being adapted to be securely mounted to a support member, a closed security container sized to fit closely within said jacket, locking means for selectively retaining or releasing said container with respect to said jacket, said container including a currency delivery tray movable into and out of said container between inserted and retracted positions, means forming a tray-receiving channel protruding into said container for guiding the movements of said tray, and means for transferring currency from said tray into said container in response to retraction of said tray from said inserted position.

2. A security box assembly for safely receiving and storing currency comprising a hollow, rigid, elongate jacket open at one end, said jacket being adapted to be securely mounted to a support member, a closed security container sized to fit closely within said jacket, locking means for selectively retaining or releasing said container with respect to said jacket, said container including a currency delivery tray movable into and out of said container between inserted and retracted positions, means forming a tray-receiving channel protruding into said container for guiding the movements of said tray, and means for transferring currency from said tray into said container in response to movement of said tray between said inserted and retracted postions, said means for transferring currency comprising a downwardly depending wiper element carried transversely of said tray within said container, pivot means supporting said element, said element depending sufficiently downwardly from said pivot means to strike an imaginary arc passing through the bottom of said tray, means for yieldingly urging said element downwardly toward the tray in a direction opposite the inward movement of said tray while permitting said element to yieldingly move upwardly to pass over currency carried by said tray as said tray moves toward said inserted position, said element being urged in a given direction along said arc to engage said tray, said tray inhibiting further movement of said element in said direction to cause said element to clear currency from said tray as said tray moves toward said retracted position.

3. A security box assembly for safely receiving and storing currency comprising a hollow, rigid, elongate jacket open at one end, said jacket being adapted to be securely mounted to a support member, a closed security container sized to fit closely within said jacket, locking means for selectively retaining or releasing said container with respect to said jacket, said container including a currency delivery tray movable into and out of said container between inserted and retracted positions, means forming a tray-receiving channel protruding into said container for guiding the movements of said tray, and means for transferring currency from said tray into said container in response to movement of said tray between said inserted and retracted positions, said means for transferring currency comprising currency sweeping means disposed above and extending across said tray, pivot means supporting said sweeping means, means yieldingly urging the sweeping means toward said tray, said sweeping means serving to pivot upwardly to pass over currency on said tray in response to movement of said tray toward said inserted position, said sweeping means serving to move downwardly along an imaginary arc passing into the bottom of said tray to be arrested by said tray so as to push currency from said tray into said container in response to movement of said tray toward said retracted position.

4. In a portable safe adapted to be disposed and locked within a housing at a work station for receiving currency therein without exposing the contents of the safe, said safe comprising a reinforced closed security container sized to fit closely within said housing, said container including a currency tray movable into and out of said container between inserted and retracted positions, and means for clearing currency from said tray between inserted and retracted positions, the means for clearing currency comprising currency sweeping means, means supporting the currency sweeping means with respect to said tray to be free to pass over currency disposed in said tray as said tray moves in a first direction, and to be inhibited from passing over currency in said tray as said tray moves in an opposite direction, said movement in said opposite direction serving to move currency against said sweeping means to transfer the currency from the tray into said container.

* * * * *